US011931863B1

(12) United States Patent
Zheng

(10) Patent No.: US 11,931,863 B1
(45) Date of Patent: Mar. 19, 2024

(54) SANDBLASTING GUN

(71) Applicant: Hongda Zheng, Zhejiang (CN)

(72) Inventor: Hongda Zheng, Zhejiang (CN)

(73) Assignee: ZHEJIANG NAN PU PNEUMATIC COMPONENT CO., LTD., Zhejiang (CN)

( * ) Notice: Subject to any disclaimer, the term of this patent is extended or adjusted under 35 U.S.C. 154(b) by 0 days.

(21) Appl. No.: 18/463,291

(22) Filed: Sep. 8, 2023

(51) Int. Cl.
*B24C 5/02* (2006.01)

(52) U.S. Cl.
CPC ..... *B24C 5/02* (2013.01)

(58) Field of Classification Search
CPC ..... B24C 5/02; B24C 5/04
See application file for complete search history.

(56) References Cited

U.S. PATENT DOCUMENTS 2,526,403 A * 10/1950 Paasche ..... B24C 5/02 451/90
2,577,465 A * 12/1951 Jones ..... B24C 3/06 451/90
4,628,644 A * 12/1986 Somers ..... B24C 5/02 222/630
5,117,872 A * 6/1992 Yie ..... F16K 31/3835 251/44
6,383,062 B1 * 5/2002 Jou ..... B24C 5/02 239/375
7,341,504 B1 * 3/2008 Chen ..... B24C 5/02 239/375
2013/0005220 A1 * 1/2013 Kountotsis ..... B24C 9/00 451/38
2021/0129291 A1 * 5/2021 Chen ..... B24C 7/0046

* cited by examiner

*Primary Examiner* — Joel D Crandall

(57) ABSTRACT

The present disclosure discloses a novel sandblasting gun. The novel sandblasting gun includes a gun body. The gun body includes an air inlet port, an air outlet port and an air channel. One end of the air channel is connected to the air inlet port and the other end of the air channel is connected to the air outlet port. Further, the gun body further includes a first feed port, a second feed port and a control valve. The first feed port and the second feed port are respectively connected to the air outlet port. A spraying material can enter the air outlet port via the first feed port and the second feed port; and the control valve is configured to control opening and closing of the first feed port and the second feed port.

10 Claims, 7 Drawing Sheets

SANDBLASTING GUN

TECHNICAL FIELD

The present disclosure relates to the technical field of sandblasting equipment, and in particular, to a novel sandblasting gun.

BACKGROUND OF THE INVENTION

A sandblasting gun uses compressed air as power to form a high-speed spray beam, which sprays spraying materials (copper ore, quartz sand, iron sand, sea sand, diamond sand, and the like) at a high speed to a surface of a workpiece to be treated, causing changes in the appearance of an outer surface of the workpiece. At present, when used, the sandblasting gun needs to be connected to a sandbox to spray spraying materials out of the sandbox. It can be understood that the sandblasting gun has a small volume itself, and the sandbox needs to move with the sandblasting gun during use. Therefore, the sandbox cannot be designed to be too large, and a total number of materials sprayed by the sandblasting gun is limited. When a large workpiece needs to be sprayed, a user often needs to frequently replace the sandbox, which is extremely inconvenient to operate. Further, when two kinds of spraying materials need to be used for being alternately sprayed, as one spray gun can only spray one kind of spraying material, a user often needs to prepare two spray guns, or uses one spray gun, but replace the sandbox constantly, which increases the usage costs and makes operations inconvenient.

SUMMARY OF THE INVENTION

The present disclosure aims to solve the technical problems of an existing sandblasting gun in the background section, and provides a novel sandblasting gun.

Specifically, the present disclosure discloses a novel sandblasting gun, including a gun body, wherein the gun body includes an air inlet port, an air outlet port, and an air channel; one end of the air channel is connected to the air inlet port, and the other end of the air channel is connected to the air outlet port; a high-pressure air enters the air channel via the air inlet port and is sprayed out by the air outlet port; the gun body further includes a first feed port, a second feed port, and a control valve; the first feed port and the second feed port are respectively connected to the air outlet port; a spraying material enters the air outlet port via the first feed port and the second feed port; and the control valve is configured to control opening and closing of the first feed port and the second feed port.

Further, the control valve includes a first valve unit and a second valve unit; the first valve unit is connected to the first feed port to control opening and closing of the first feed port; and the second valve unit is connected to the second feed port to control opening and closing of the second feed port.

Further, the first feed port is provided with a first opening on a side wall; the first opening transversely penetrates through the first feed port; the first valve unit includes a first connection shaft; and the first connection shaft is threaded into the first opening to close the first feed port.

Further, the first connection shaft is provided with a through hole penetrating through the first connection shaft; and the first connection shaft rotates in the first opening until the through hole is communicated with the first feed port to open the first feed port.

Further, the first connection shaft is provided with a knob at one end and is provided with a first limiting portion at the other end; a second limiting portion is arranged on one side, adjacent to the first limiting portion, of the first opening; the knob is configured to control the first connection shaft to rotate; and the first limiting portion and the second limiting portion are configured to restrain a rotation range of the first connection shaft.

Further, the second feed port is provided with a second opening on a side wall; the second opening transversely penetrates through the second feed port; the second valve unit includes a second connection shaft; and the second connection shaft is threaded into the second opening to close the second feed port.

Further, the second valve unit further includes an elastic plugging shaft; and the elastic plugging shaft is threaded into the second opening from a side opposite to the second connection shaft to push the second connection shaft out of the second opening to open the second feed port.

Further, the gun body further includes a triggering member and a closing member; the closing member is connected to the air channel; the triggering member is connected to the closing member; the triggering member is configured to control the closing member to move between a first position and a second position; when the closing member moves from the first position to the second position, the air channel is opened; and when the closing member moves from the second position to the first position, the air channel is closed.

Further, the novel sandblasting gun further includes a first spraying material box and a second spraying material box; the first spraying material box is connected to the first feed port; and the second spraying material box is connected to the second feed port.

Further, the novel sandblasting gun further includes a nozzle, wherein the nozzle is connected to the air outlet port.

Compared with the prior art, the present disclosure has the beneficial effects below: the gun body of the present disclosure is provided with the first feed port and the second feed port. The first feed port and the second feed port are respectively connected to the air outlet port. a spraying material enters the air outlet port respectively via the first feed port and the second feed port. Due to the above structural arrangement, the gun body of the present disclosure can be connected with the first spraying material box and the second spraying material box respectively through the first feed port and the second feed port, a user can use the control valves to control the spraying materials to enter the air outlet port from different feed ports, so as to select different spraying material boxes.

Specifically, when the spraying material in the first spraying material box needs to be used, the first feed port can be opened through the control valve, and the second feed port is closed at the same time. In this case, the spraying material in the first spraying material box will enter the air outlet port via the first feed port and be sprayed out from the air outlet port through the high-pressure air. When the spraying material in the second spraying material box needs to be used, the second feed port can be opened through the control valve, and the first feed port is closed at the same time. When the high-pressure air passes through the air outlet port, a negative pressure will be generated at the second feed port. Under the action of the negative pressure, the spraying material in the second spraying material box will be sucked into the air outlet port and sprayed out from the air outlet port.

To sum up, the present disclosure can select different spraying material boxes through the control valves, which increases a total spraying amount of the sandblasting gun. When a relatively large workpiece needs to be sprayed, if the spraying material in one spraying material box is used up, a user can perform switching to the other spraying material box through the control valve to continue the spraying. The operation is simple and convenient; the step of replacing the spraying material box is eliminated; and the spraying efficiency is improved. Further, in this embodiment, the first spraying material box and the second spraying material box can store different kinds of spraying materials. When two kinds of different spraying materials need to be simultaneously used for cross spraying, the user can achieve the cross spraying of the different kinds of spraying materials by switching between the different spraying material boxes. The user neither needs to match two spray guns nor needs to frequently replace the spraying material box, which saves the use costs, simplifies the operation, and improves the spraying efficiency.

DETAILED DESCRIPTION

Figure 1:
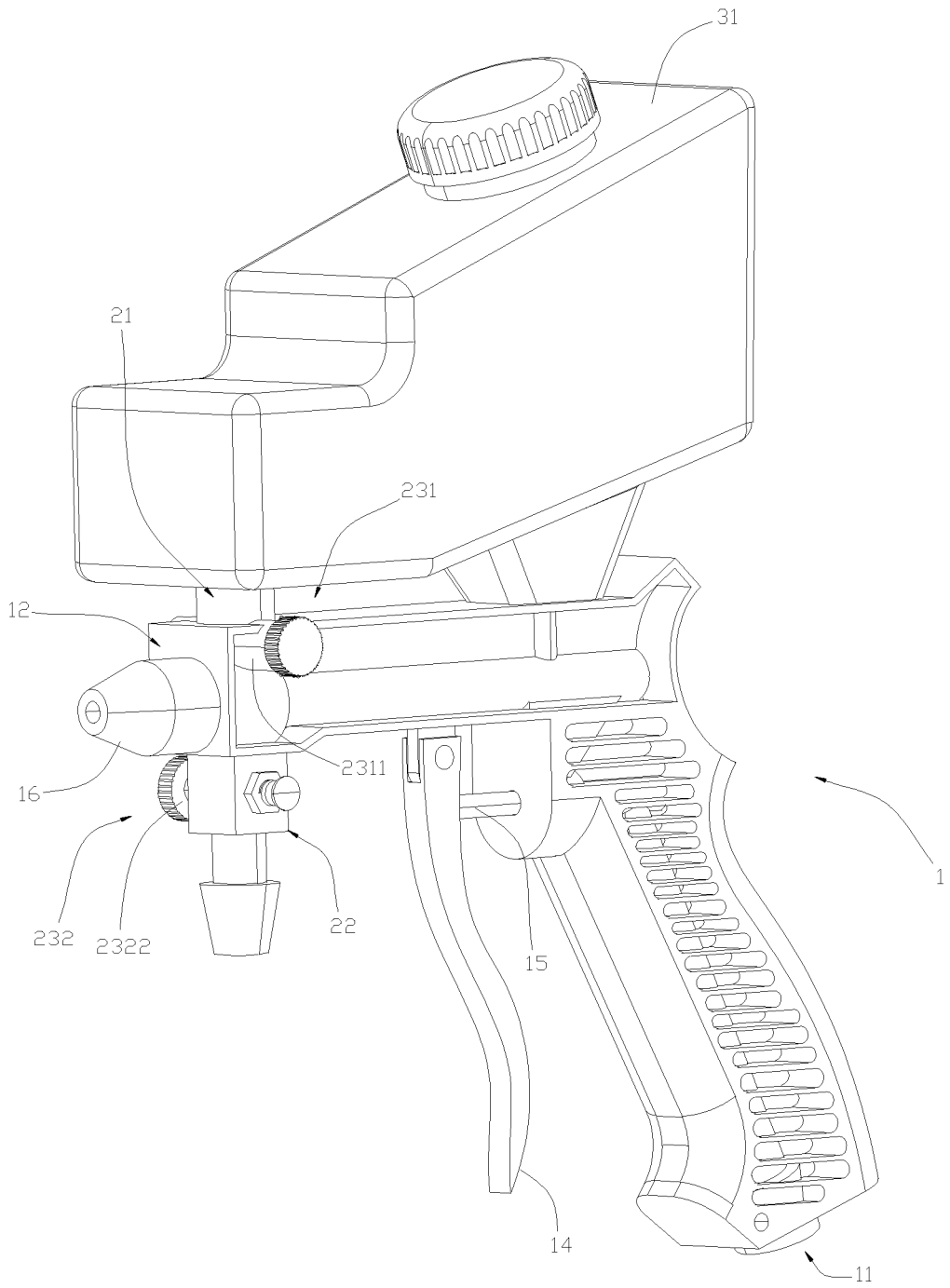
FIG. 1 is a three-dimensional state diagram of the present disclosure.

It is to be noted that embodiments in the present disclosure and features in the embodiments may be combined with each other without conflict.

In the description of the present disclosure, It is to be understood that, The terms "center", "longitudinal", "transverse", "upper", "lower", "front", "rear", "left", "right", "vertical", "horizontal", "top", "bottom", "inner", "outer", and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure; in addition, The terms "first" and "second" are used for descriptive purposes only, While not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In the description of the present disclosure, it is to be noted that unless otherwise expressly specified and defined, the terms "mounted", "connected", and "feeding" are to be construed broadly, for example, as either a fixed feeding, or a detachable feeding, or an integral feeding, either a mechanical feeding, or an electrical feeding. The specific meaning of the above term in the present disclosure will be understood by those of ordinary skill in the art depending on the particular circumstances, either directly or indirectly via an intermediate medium, communication between the two elements, or interaction between the two elements. The specific meanings of these terms in the present disclosure will be understood by those of ordinary skill in the art as the case may be.

Figure 2:
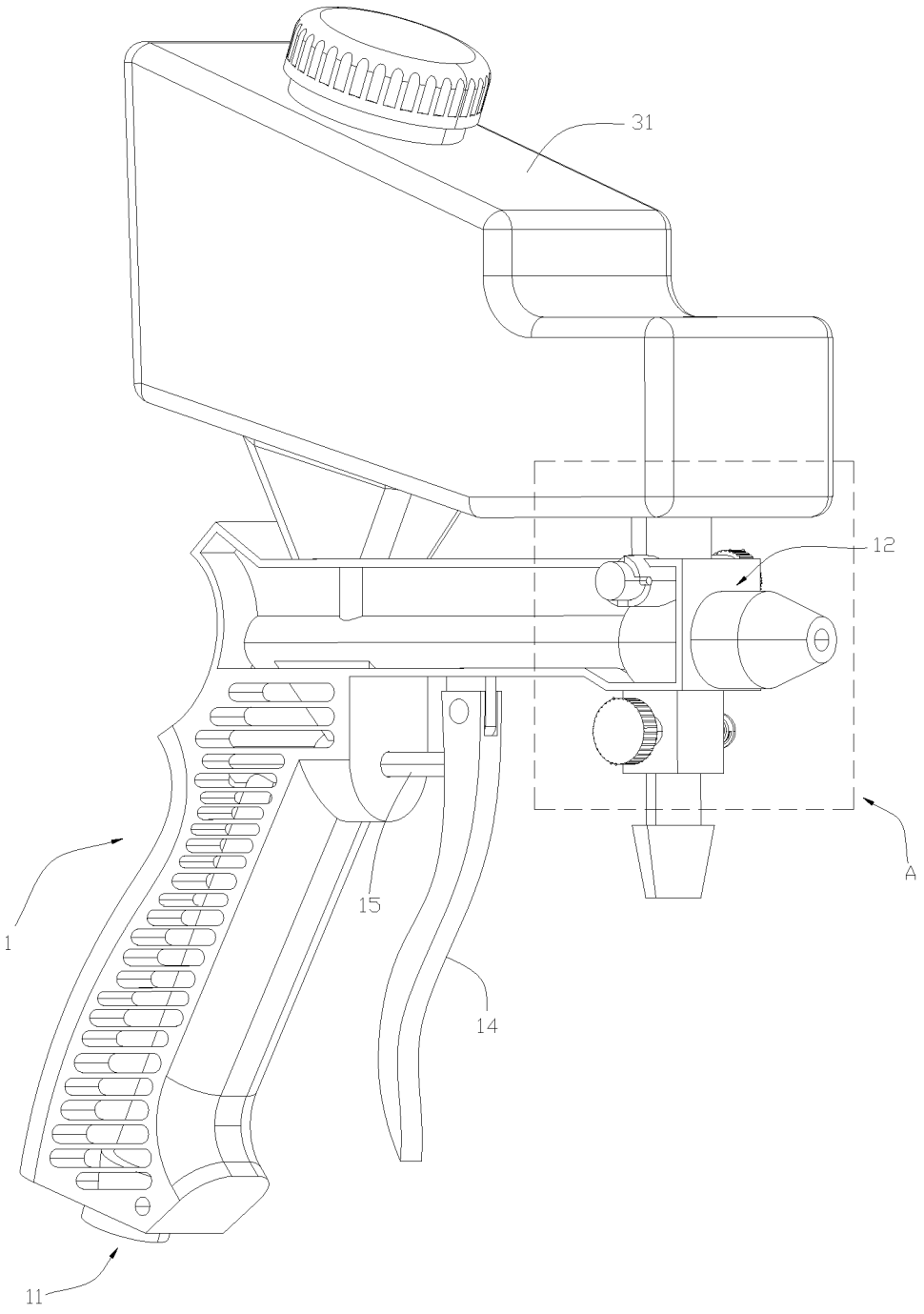
FIG. 2 is another three-dimensional state diagram of the present disclosure.
Figure 3:
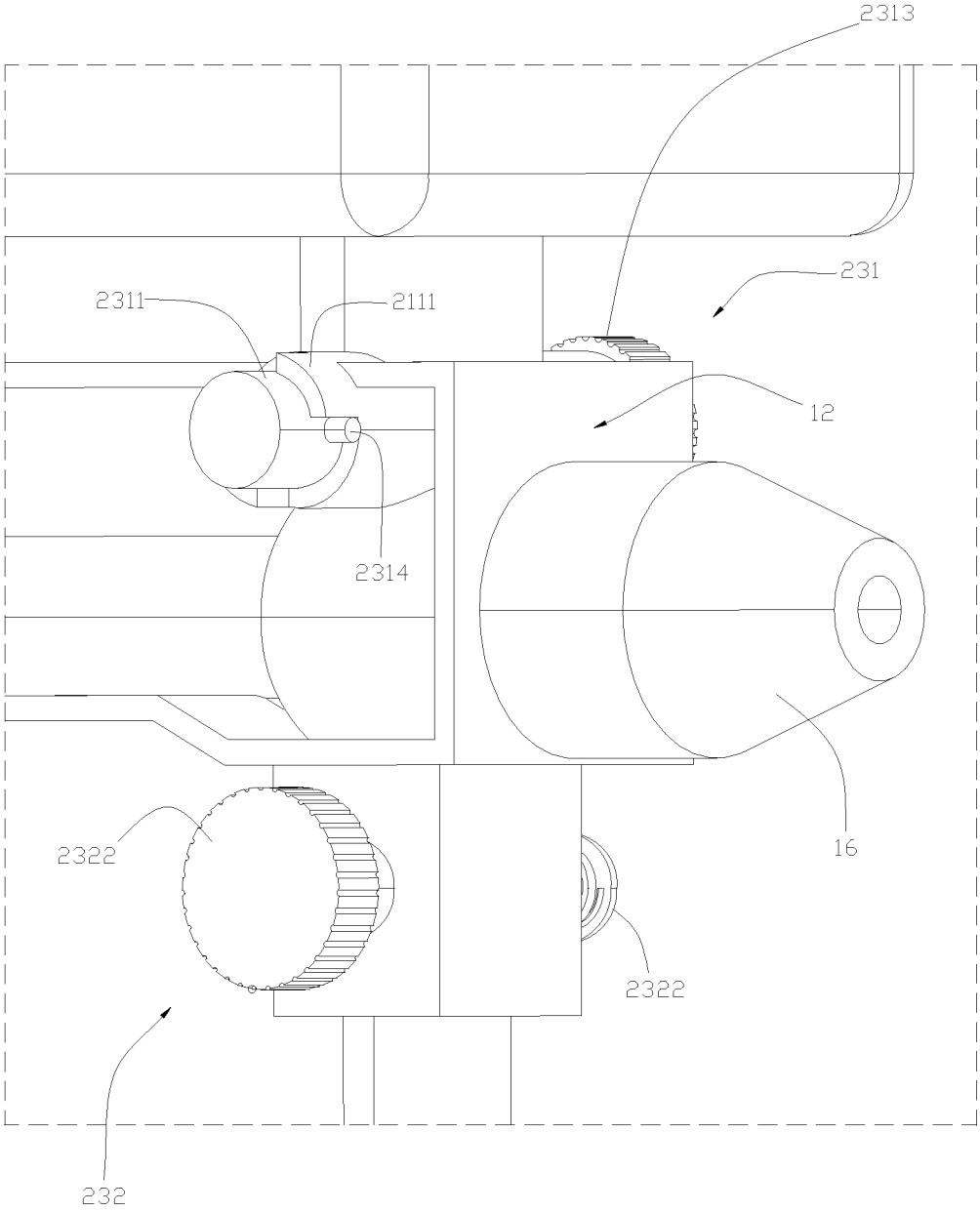
FIG. 3 is a partially enlarged diagram of a portion A of the present disclosure.
Figure 4:
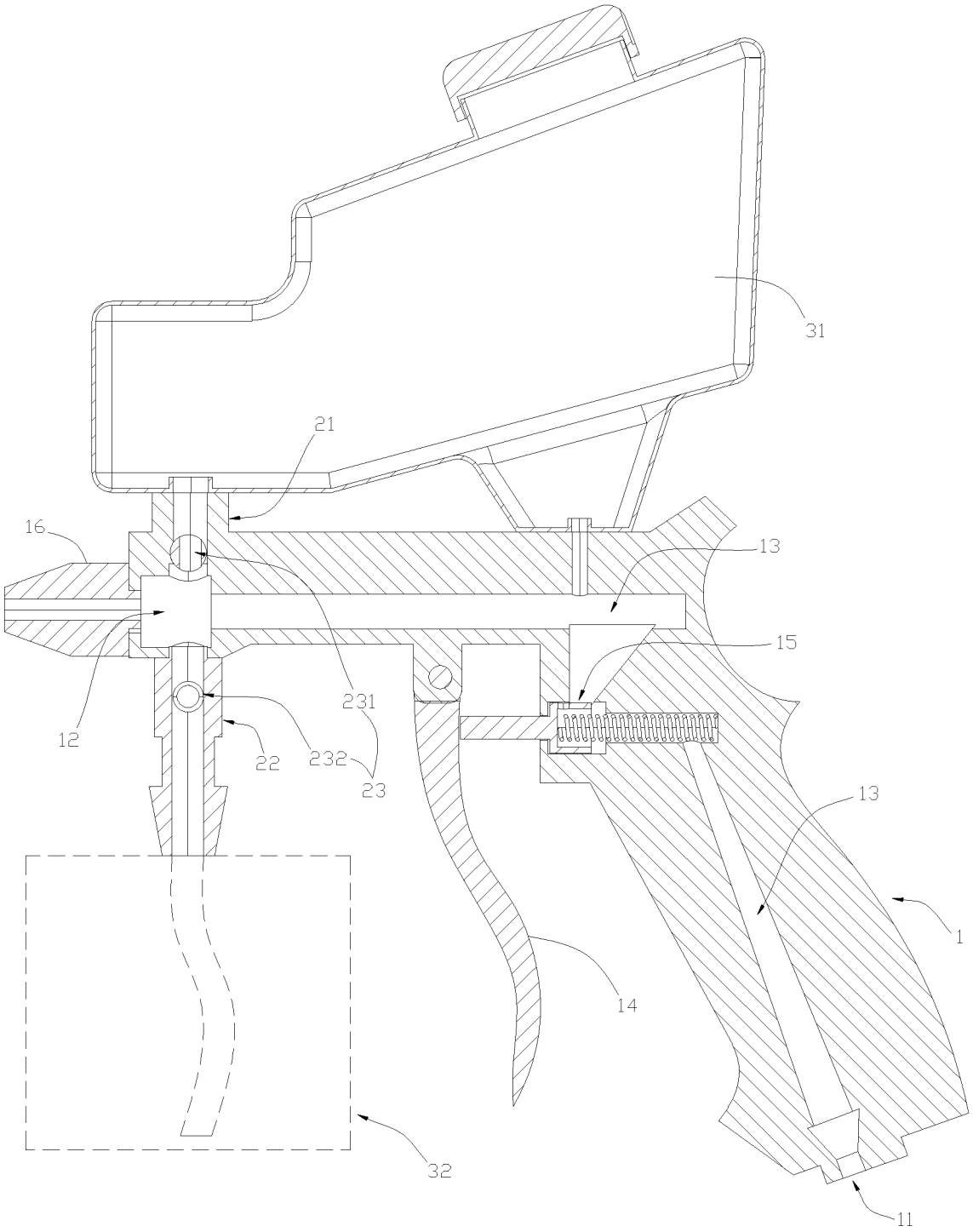
FIG. 4 is a schematic diagram of a sectional state of the present disclosure.
Figure 5:
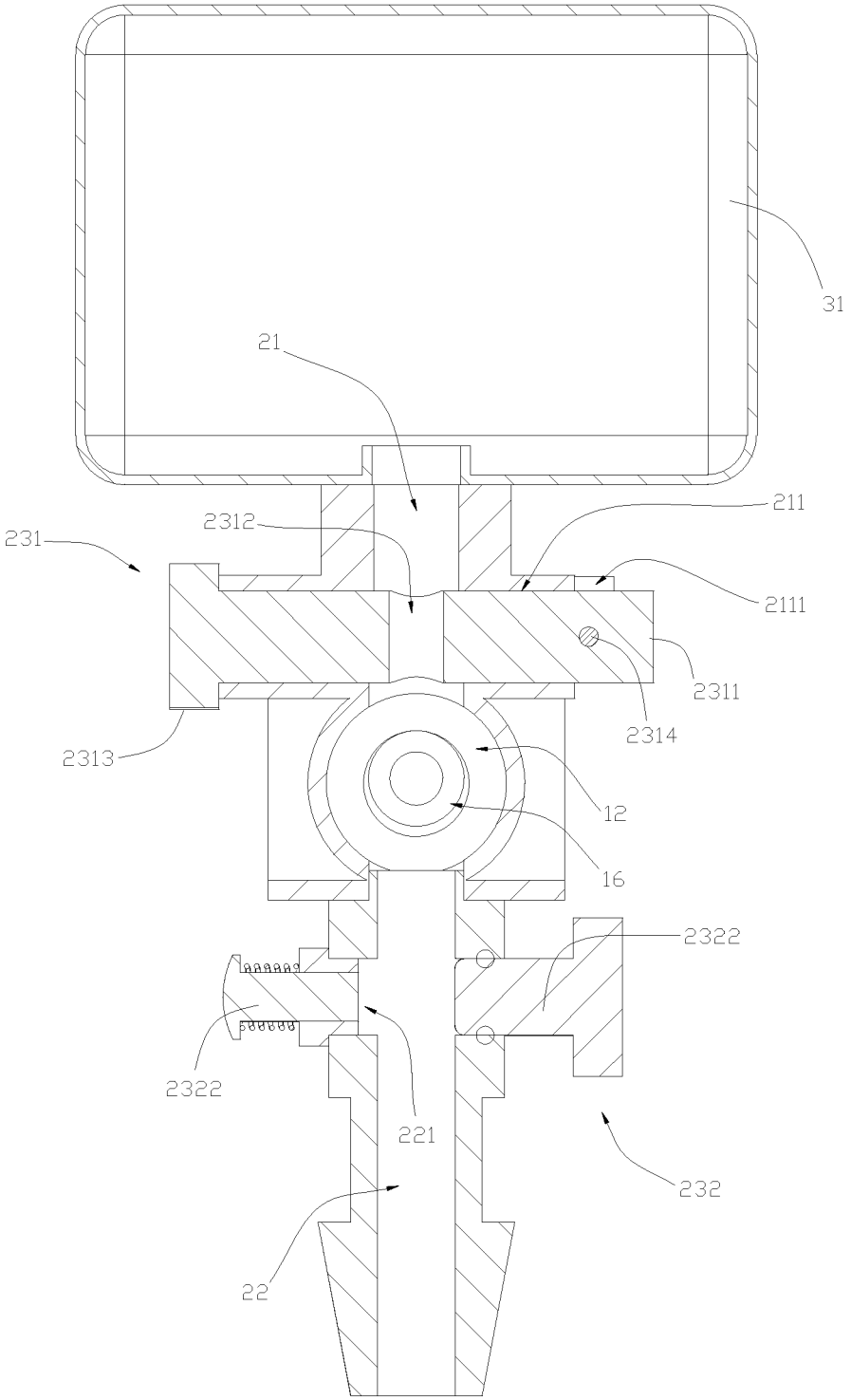
FIG. 5 is a sectional diagram of a connected state of an air outlet port and a first feed port as well as a second feed port of the present disclosure (wherein the first feed port and the second feed port are both in an open state).
Figure 6:
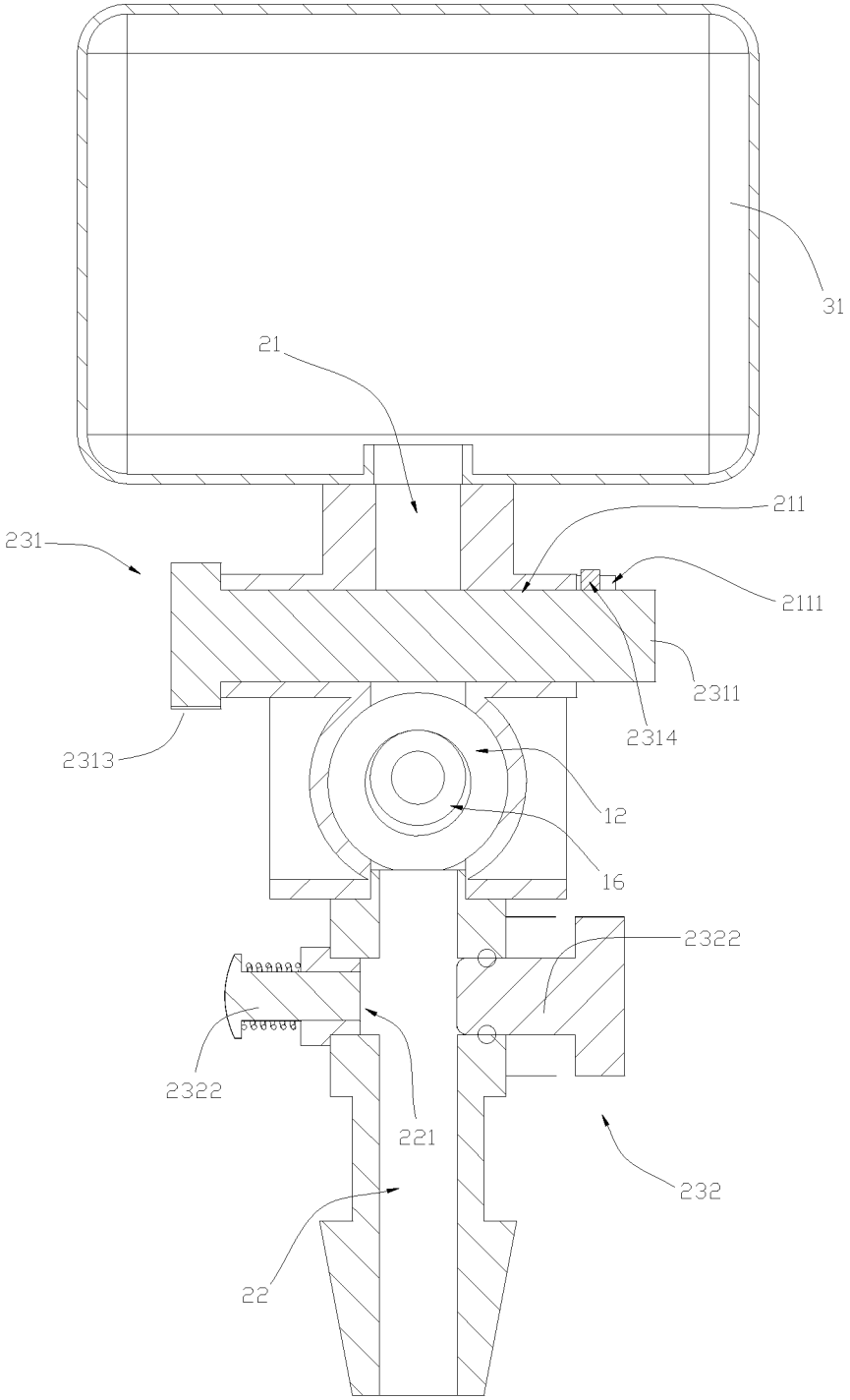
FIG. 6 is a sectional diagram of a connected state of an air outlet port and a first feed port as well as a second feed port of the present disclosure (wherein the first feed port is in a closed state, and the second feed port is in an open state).
Figure 7:
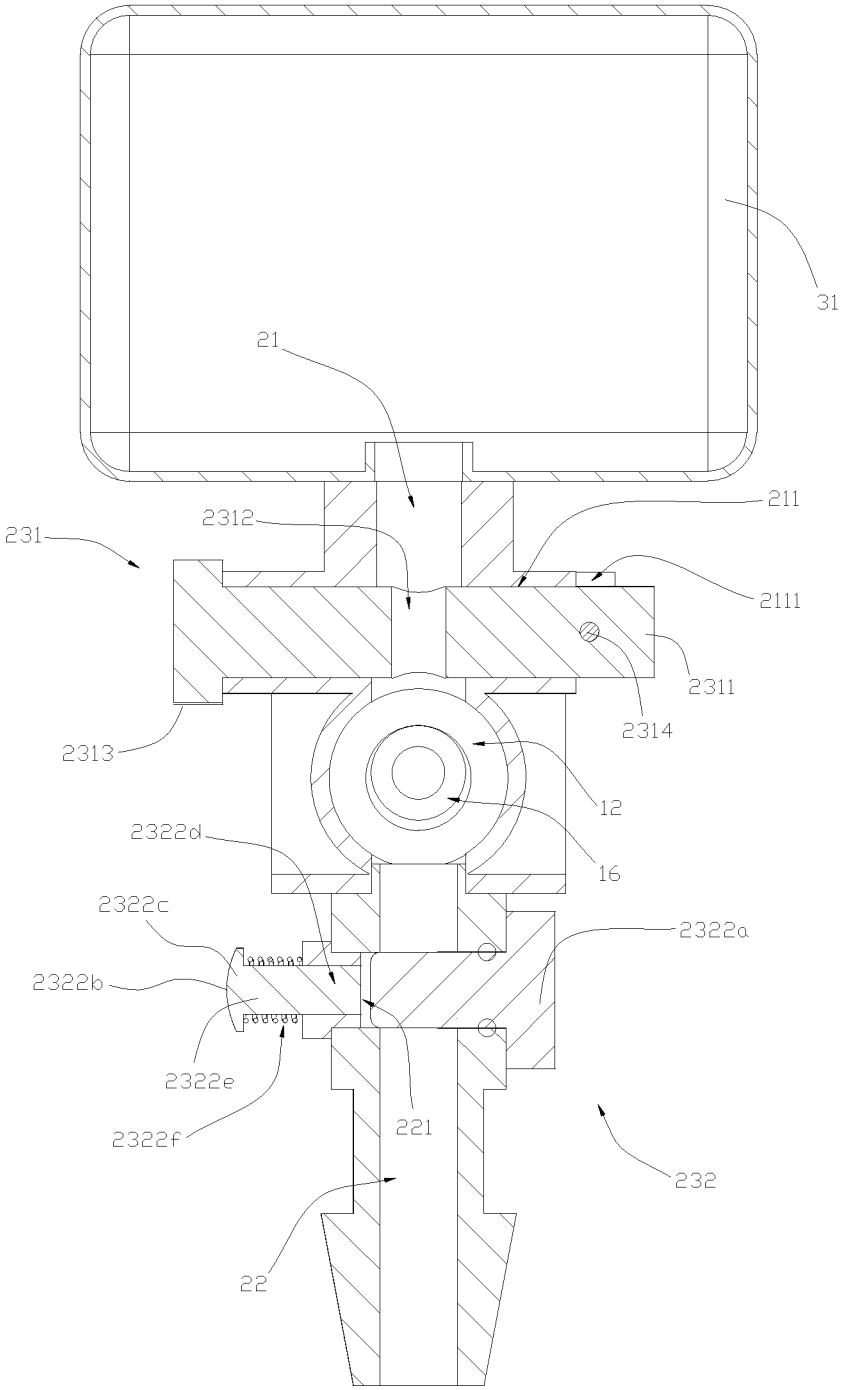
FIG. 7 is a sectional diagram of a connected state of an air outlet port and a first feed port as well as a second feed port of the present disclosure (wherein the first feed port is in an open state, and the second feed port is in a closed state).

As shown in FIG. 1 to FIG. 7, this embodiment provides a novel sandblasting gun, including a gun body 1. The gun body 1 includes an air inlet port 11, an air outlet port 12, and an air channel 13. One end of the air channel 13 is connected to the air inlet port 11, and the other end is connected to the air outlet port 12. Due to the above structural arrangement, the high-pressure air enters the air channel 13 via the air inlet port 11 and be sprayed out via the air outlet port 12.

Further, in this embodiment, the gun body 1 further includes a first feed port 21 and a second feed port 22. The first feed port 21 and the second feed port 22 are respectively connected to the air outlet port 12. A spraying material enters the air outlet port 12 via the first feed port 21 the second feed port 22. Further, the first feed port 21 and the second feed port 22 are both provided with control valves 23. The control valves 23 are configured to control opening and closing of the first feed port 21 and the second feed port 22.

Further, in this embodiment, the gun body 1 further includes a first spraying material box 31 and a second spraying material box 32. The first spraying material box 31 and the second spraying material box 32 are configured to store spraying materials. The first spraying material box 31 is connected to the first feed port 21, and the second spraying material box 32 is connected to the second feed port 22.

It can be understood that the gun body 1 of the present disclosure is provided with the first feed port 21 and the second feed port 22. The first feed port 21 and the second feed port 22 are respectively connected to the air outlet port 12. Due to the above structural arrangement, a spraying material in the first spraying material box 31 and a spraying material in the second spraying material box 32 enters the air outlet port 12 respectively via the first feed port 21 and the second feed port 22.

Due to the above structural arrangement, a user can use the control valves 23 to control the spraying materials to enter the air outlet port 12 from different feed ports, so as to select different spraying material boxes. Specifically, in this embodiment, the first feed port 21 is arranged above the air outlet port 12, and the second feed port 22 is arranged below the air outlet port 12.

When the spraying material in the first spraying material box 31 needs to be used, the first feed port 21 can be opened through the control valve 23, and the second feed port 22 is closed at the same time. In this case, the spraying material in the first spraying material box 31 will enter the air outlet port 12 via the first feed port 21 under the gravity and be sprayed out from the air outlet port 12 through the high-pressure air. When the spraying material in the second spraying material box 32 needs to be used, the second feed port 22 can be opened through the control valve 23, and the first feed port 21 is closed at the same time. When the high-pressure air passes through the air outlet port 12, a negative pressure will be generated at the second feed port 22. Under the action of the negative pressure, the spraying material in the second spraying material box 32 will be sucked into the air outlet port 12 and sprayed out from the air outlet port 12.

Due to the above structural arrangement, the present disclosure can select different spraying material boxes through the control valves 23, which increases a total spraying amount of the sandblasting gun. When a relatively large workpiece needs to be sprayed, if the spraying material in one spraying material box is used up, a user can perform switching to the other spraying material box through the control valve 23 to continue the spraying. The operation is simple and convenient; the step of replacing the spraying material box is eliminated; and the spraying efficiency is improved. Further, in this embodiment, the first spraying material box 31 and the second spraying material box 32 can store different kinds of spraying materials. When two kinds of different spraying materials need to be simultaneously used for cross spraying, the user can achieve the cross spraying of the different kinds of spraying materials by switching between the different spraying material boxes. The user neither needs to match two spray guns nor needs to frequently replace the spraying material box, which saves the use costs, simplifies the operation, and improves the spraying efficiency.

Due to the above structural arrangement, the gun body can be connected to different sandboxes respectively through the first feed port and the second feed port, to increase the total spraying amount of the sandblasting gun. During use, the user can select different sandboxes through the control valves. When a relatively large workpiece needs to be sprayed, the step of frequently replacing the spraying material box is eliminated; the operation is simple and convenient; and the spraying efficiency is improved.

Further, in this embodiment, the control valve 23 includes a first valve unit 231 and a second valve unit 232. The first valve unit 231 is connected to the first feed port 21 to control opening and closing of the first feed port 21. The second valve unit 232 is connected to the second feed port 22 to control opening and closing of the second feed port 22.

Further, as an implementation of this embodiment, the first feed port 21 is provided with a first opening 211 on a side wall. The first opening 211 transversely penetrates through the first feed port 21. The first valve unit 231 includes a first connection shaft 2311. The first connection shaft 2311 is threaded into the first opening 211. Due to the above structural arrangement, the spraying material entering via the first feed port 21 is blocked by the first connection shaft 2311 before entering the air outlet port 12, so as to close the first feed port 21. Further, the first connection shaft 2311 is provided with a through hole 2312 penetrating through the first connection shaft 2311. The first connection shaft 2311 can rotate in the first opening 211. When the first connection shaft 2311 rotates until the through hole 2312 overlaps the first feed port 21, the spraying material blocked by the first connection shaft 2311 enters the air outlet port via the through hole 2312, so as to open the first feed port 21.

Further, in this embodiment, the first connection shaft 2311 is provided with a knob 2313 at one end, and the user can hold the knob 2313 to rotate the first connection shaft 2311. Further, the first connection shaft 2311 is provided with a first limiting portion 2314 at an end opposite to the knob 2313. The first opening 211 is provided with a second limiting portion 2111 at the first limiting portion 2314, and the first limiting portion 2314 and the second limiting portion 2111 are configured to restrain a rotation range of the first connection shaft 2311. Specifically, in this embodiment, the first limiting portion 2314 is a crossbar protruding out of a surface of the first connection shaft 2311, and the second limiting portion 2111 includes a first limiting block and a second limiting block. The first connection shaft 2311 rotates to drive the crossbar to rotate between the first limiting block and the second limiting block. It can be understood that the crossbar can only rotate between the first limiting block and the second limiting block at most. When the crossbar rotates to resist against the first limiting block, the first feed port 21 is opened; and when the crossbar rotates to resist against the second limiting block, the first feed port 21 is closed.

Further, as an implementation of this embodiment, the second feed port 22 is provided with a second opening 221 on a side wall. The second opening 221 transversely penetrates through the second feed port 22. The second valve unit 232 includes a second connection shaft 2321. The second connection shaft 2321 is threaded into the second opening 221. Due to the above structural arrangement, the spraying material entering via the second feed port 22 is blocked by the second connection shaft 2321 before entering the air outlet port 12, so as to close the second feed port 22. Further, the second valve unit 232 further includes an elastic plugging shaft 2322. The elastic plugging shaft 2322 can be threaded into the second opening 221 on a side opposite to the second connection shaft 2321. Due to the above structural arrangement, when the second feed port needs to be opened, the elastic plugging shaft 2322 can be pressed to be threaded into the second opening 221, so as to push the second connection shaft 2321 out of the second opening 221. When the second connection shaft 2321 is pushed out, the elastic plugging shaft 2322 rebounds to open the second feed port 22. The elastic plugging shaft 2322 includes an elastic element **2322*b* and a plugging shaft 2322*a*, the elastic element 2322*b* includes a first end 2322*c*, a second end 2322*d*, a main shaft 2322*e* connected between the first end 2322*c* and the second end 2322*d* and a spring 2322*f* sleeved on the main shaft 2322. The second end 2322*d* is connected the plugging shaft 2322*a*. Two ends of the spring 2322*f* abut against the first end 2322*c* and the plugging shaft 2322*a*** respectively.

It should be noted that the above specific implementations of the first valve unit 231 and the second valve unit 232 should not be understood as the first valve unit 231 and the second valve unit 232 being the aforementioned structures only. Specifically, both the first valve unit 231 and the second valve unit 232 can both achieve the opening of the feed ports by forming the through holes in the connection shafts, or, the first valve unit 231 and the second valve unit 232 can both achieve the opening of the feed ports by arranging the elastic plugging shafts 2322. In addition, the first valve unit 231 and the second valve unit 232 can also be of other structures that can achieve the opening and closing of the feed ports.

Further, in this embodiment, the gun body 1 further includes a triggering member 14 and a closing member 15. The closing member 15 is threaded into the gun body 1 and is connected to the air channel 13. The triggering member 14 is connected to the closing member 15. The triggering member 14 is configured to control the closing member 15 to move between a first position and a second position. When the closing member 15 moves from the first position to the second position, the air channel 13 can be opened. When the closing member 15 moves from the second position to the first position, the air channel 13 can be closed. Specifically, in this embodiment, the closing member 15 includes an elastic connecting rod and a plug. The plug is arranged on the elastic connecting rod, and the triggering member is a trigger. The user can apply a pressure to the elastic connecting rod by pulling the trigger, so as to compress the elastic connecting rod. In this case, the plug will move from the first position to the second position to open the air channel 13. After the pressure is withdrawn, the elastic connecting rod extends, and the plug will move from the second position to the first position to close the air channel 13.

Further, in this embodiment, the gun body 1 further includes a nozzle 16. The nozzle 16 is connected to the air outlet port 12. The nozzle 16 can make the spraying material sprayed via the air outlet port 12 more uniform and divergent.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A novel sandblasting gun, comprising a gun body, wherein the gun body comprises an air inlet port, an air outlet port, and an air channel; one end of the air channel is connected to the air inlet port, and the other end of the air channel is connected to the air outlet port; wherein a high-pressure air enters the air channel via the air inlet port and is sprayed out by the air outlet port; the gun body further comprises a first feed port, a second feed port, and a control valve; the first feed port and the second feed port are respectively connected to the air outlet port; wherein a spraying material enters the air outlet port via the first feed port and the second feed port; and the control valve is configured to control opening and closing of the first feed port and the second feed port, wherein the control valve comprises a first valve unit and a second valve unit; the first valve unit is connected to the first feed port to control opening and closing of the first feed port; and the second valve unit is connected to the second feed port to control opening and closing of the second feed port, wherein the first feed port is provided with a first opening on a side wall; the first opening transversely penetrates through the first feed port; the first valve unit comprises a first connection shaft; and the first connection shaft is threaded into the first opening to close the first feed port.

2. The novel sandblasting gun according to claim 1, wherein the first connection shaft is provided with a through hole penetrating through the first connection shaft; and the first connection shaft rotates in the first opening until the through hole is communicated with the first feed port to open the first feed port.

3. The novel sandblasting gun according to claim 2, wherein the first connection shaft is provided with a knob at one end and is provided with a first limiting portion at the other end; a second limiting portion is arranged on one side, adjacent to the first limiting portion, of the first opening; the knob is configured to control the first connection shaft to rotate; and the first limiting portion and the second limiting portion are configured to restrain a rotation range of the first connection shaft.

4. The novel sandblasting gun according to claim 1, wherein the second feed port is provided with a second opening on a side wall; the second opening transversely penetrates through the second feed port; the second valve unit comprises a second connection shaft; and the second connection shaft is threaded into the second opening to close the second feed port.

5. The novel sandblasting gun according to claim 4, wherein the second valve unit further comprises an elastic plugging shaft; and the elastic plugging shaft is threaded into the second opening from a side opposite to the second connection shaft to push the second connection shaft out of the second opening to open the second feed port.

6. The novel sandblasting gun according to claim 1, wherein the gun body further comprises a triggering member and a closing member; the closing member is connected to the air channel; the triggering member is connected to the closing member; the triggering member is configured to control the closing member to move between a first position and a second position; when the closing member moves from the first position to the second position, the air channel is opened; and when the closing member moves from the second position to the first position, the air channel is closed.

7. The novel sandblasting gun according to claim 1, further comprising a first spraying material box and a second spraying material box; the first spraying material box is connected to the first feed port; and the second spraying material box is connected to the second feed port.

8. The novel sandblasting gun according to claim 1, further comprising a nozzle, wherein the nozzle is connected to the air outlet port.

9. The novel sandblasting gun according to claim 5, wherein the elastic plugging shaft comprises an elastic element and a plugging shaft, the elastic element includes a first end, a second end, and a main shaft connected between the first end and the second end, the second end is connected the plugging shaft.

10. The novel sandblasting gun according to claim 9, wherein the elastic element further comprises a spring sleeved on the main shaft, and two ends of the spring abut against the first end and the plugging shaft respectively.

* * * * *